United States Patent [19]

Beck et al.

[11] 4,064,017

[45] Dec. 20, 1977

[54] METHOD OF OPERATING COKE OVENS

[75] Inventors: Kurt-Günther Beck; Wolfgang Rohde, both of Essen; Dieter Stalherm, Recklinghausen; Volker Kolitz, Gelsenkirchen, all of Germany

[73] Assignee: Bergwerksverband GmbH, Essen, Germany

[21] Appl. No.: 597,917

[22] Filed: July 21, 1975

[30] Foreign Application Priority Data

July 19, 1974 Germany ..... 2434723

[51] Int. Cl.[2] ..... C10B 21/10

[52] U.S. Cl. ..... 201/1; 201/44

[58] Field of Search ..... 201/1, 41, 44; 202/151

[56] References Cited

U.S. PATENT DOCUMENTS

| | | | |
|---|---|---|---|
| 1,458,964 | 6/1923 | Baille-Barrelle | 201/41 |
| 3,491,356 | 1/1970 | Schuroff | 201/1 X |
| 3,607,660 | 9/1971 | Kumper | 202/151 X |
| 3,803,002 | 4/1974 | Skraba et al. | 203/2 X |
| 3,875,016 | 4/1975 | Schmidt-Balve et al. | 201/1 X |

FOREIGN PATENT DOCUMENTS

| | | | |
|---|---|---|---|
| 2,017,021 | 5/1970 | France | 201/1 |

*Primary Examiner*—Morris O. Wolk
*Assistant Examiner*—Arnold Turk
*Attorney, Agent, or Firm*—Michael J. Striker

[57] ABSTRACT

A cokable substance such as coal is admitted into a coking chamber. A quantity of heat which is sufficient to cause coking of the cokable substance is supplied to the chamber during preselected time intervals within the coking period in which coking of the cokable substance progresses in response to the supply of heat. On the other hand, during other time intervals within the coking period in which coking of the cokable substance is essentially unaffected by the supply of heat, the quantity of heat supplied to the chamber is reduced to a level below that required to sustain coking of the cokable substance during the preselected time intervals. In this manner, savings in energy may be realized. The supply of heat to the chamber during those time intervals in which coking of the cokable substance is unaffected by the supply of heat may be discontinued completely.

13 Claims, 1 Drawing Figure

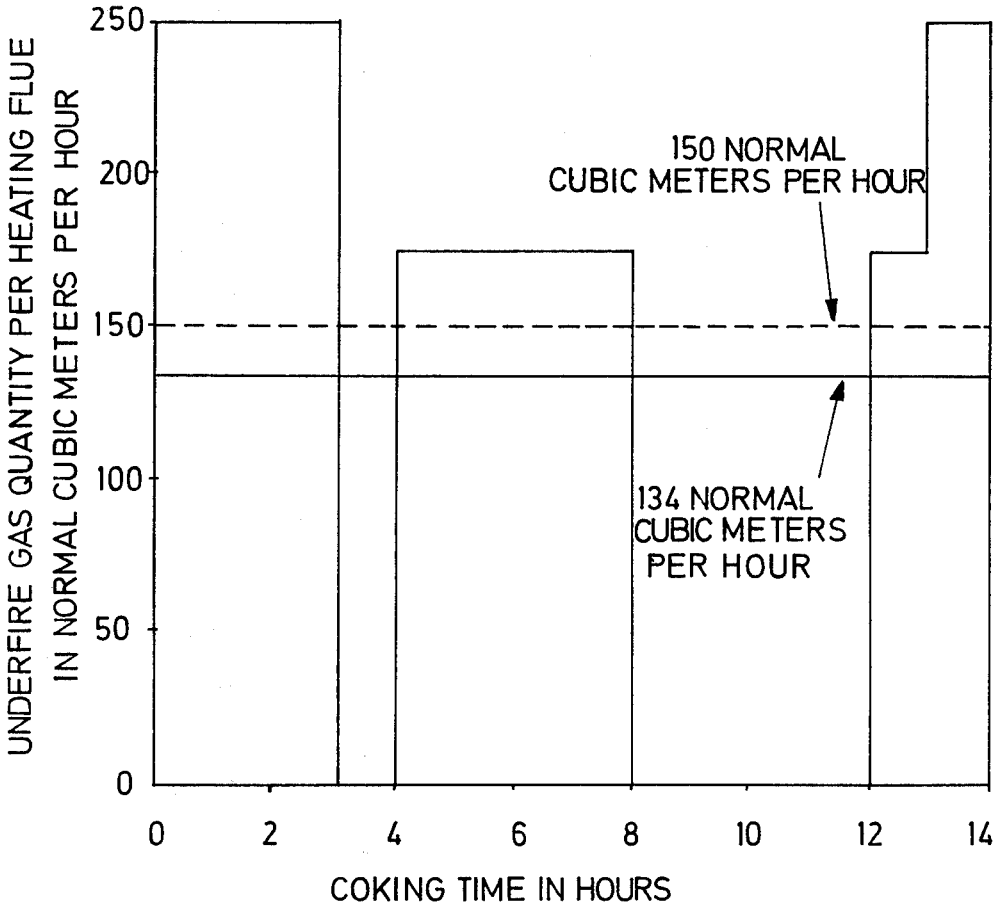
UNDERFIRE GAS QUANTITY PER HEATING FLUE
IN NORMAL CUBIC METERS PER HOUR
250
200
150
100
50
0
150 NORMAL
CUBIC METERS PER HOUR
134 NORMAL
CUBIC METERS
PER HOUR
0
2
4
6
8
10
12
14
COKING TIME IN HOURS

METHOD OF OPERATING COKE OVENS

BACKGROUND OF THE INVENTION

The invention relates generally to coking methods. Of particular interest to the invention are methods of operating coke ovens or batteries of coke ovens.

One of the methods used in the past for the coking of coal consists in continuously supplying a predetermined quantity of heat to the coking chambers during the coking period.

In order to save on the heating costs involved in this classical heating method, it has further become known to coke coal by supplying large quantities of heat through the heating flues during the earlier stages of the coking period and to gradually reduce the heat supply to the coking chambers towards the end of the coking period. In this manner, a savings in heat of about 10 percent may be achieved as opposed to the classical heating method which operates with a constant heat supply. At the same time, a reduction in the coking period is realized due to the extremely high temperatures which exist in the heating flues during the earlier stages of the coking period. The shortened coking period, in turn, permits a higher throughput capacity to be obtained for the individual ovens of a coke oven battery.

The gradual reduction in the heat supplied to the heating flues may be effected with reasonable precision by using an appropriate regulating device in conjunction with a suitable programming technique. This regulating device must be effective for providing good control of the values leading to the heating flues.

Although it is true that a gradual reduction in the heat supply towards the end of the coking period makes it possible to achieve savings in heat, this procedure is nevertheless not completely reliable as regards the satisfactory attainment of this goal. Thus, improvements in the state of the art are desirable.

SUMMARY OF THE INVENTION

Accordingly, it is an object of the invention to provide a coking method which enables savings in heating costs to be achieved more reliably than heretofore.

Another object of the invention is to provide a coking method which enables savings in heating costs to be realized while permitting coking to be effected in an exact manner.

These objects, as well as others which will become apparent as the description proceeds, are achieved in accordance with the invention. One aspect of the invention relates to a coking method wherein a cokable substance is admitted into at least one coking chamber. A quantity of heat which is sufficient to cause coking of this substance is supplied to the chamber during preselected time intervals within the coking period in which coking of the cokable substance progresses in response to the supply of heat. During other time intervals within the coking period in which coking of the cokable substance is substantially uninfluenced by the supply of heat, the quantity of heat supplied to the coking chamber is reduced to a level which is less than that required to sustain coking of the cokable substance during the preselected time intervals. In this manner, the energy used for coking of the cokable substance may be decreased.

In accordance with one embodiment of the invention, the quantity of heat supplied to the coking chamber during at least one of those time intervals wherein the cokable substance is substantially uninfluenced by the supply of heat is reduced to substantially zero.

The invention may be applied to a single coking chamber or coke oven as well as to a series of coking chambers or coke ovens. In the latter case, an arrangement is possible wherein all or several of the coking chambers or coke ovens together constitute a group. The substance to be coked may here be admitted into the various chambers or ovens of the group and the operation of supplying sufficient heat to cause coking during those time intervals wherein coking progresses in response to the supply of heat may be carried out concurrently for all of the chambers or ovens of the group. Similarly, the operation of reducing the supply of heat may be carried out concurrently for all of the chambers or ovens of the group.

The novel features which are considered as characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

BRIEF DESCRIPTION OF THE DRAWING

The singe FIGURE graphically illustrates one manner of carrying out a method in accordance with the invention.

DESCRIPTION OF THE PREFERRED EMBODIMENTS

A preferred application of the coking method of the invention is to the coking of coal and the latter will, for the purposes of the present description, be assumed to constitute the substance to be coked. The coke oven or coke ovens used for coking the coal may be heated by the combustion of a suitable fuel and may be provided with heating flues for the introduction of heat into the oven chamber or oven chambers. In the following description, the coke ovens will be assumed to be gas-fired.

In one of its aspects, then, the invention relates to a method of operating coke ovens or coke oven batteries for the purpose of coking coal and wherein the heating of the heating flues provided for the oven chambers is changed during the coking period.

It has now been found that a coking operation carried out while the heat supply to the individual ovens or oven groups is changed may be effected with precision and, in general, with greater reliability than heretofore as regards the savings of heat which are achieved, by periodically reducing the heat supply to the individual ovens or oven groups during the coking period. As indicated earlier, the reduction in the heat supply may involve shutting off the heat supply substantially completely. It has been surprisingly determined that, by means of such an "interval coking", the coking of the coal is completed in practically the same amount of time as in ovens which are heated in a continuous manner. Moreover, as is indicated by the results of measurements which have been made, greater savings in heat are also achieved.

The achievement of the invention may be explained in that the coking process which occurs in the individual ovens requires a certain amount of time which cannot, for all practical purposes, be reduced regardless of the intensity of the heating. Thus, in the conventional coking methods, more heat than necessary is supplied for at least part of the time. This excess heat is then lost via the waste gases as well as in the form of radiation losses and enthalpy of the coking products.

Careful experiments have shown that, after about 20 to 35 percent of the coking period has elapsed, the coking operation is, for a certain time interval, hardly caused to progress by heating. The same applies for a certain time interval following completion of about 50 to 95 percent of the coking period. For instance, in the time interval following completion of about 20 to 35 percent of the coking period and during a duration of about 5 to 15% of said coking period and in the time interval following completion of at least about 50 to 60 percent of the coking period and during a duration of about 20 to 35 per cent of said coking period, it was surprisingly observed that the progression of the coking operation was maintained even without any substantial supply of heat.

The invention will now be further illustrated with reference to the single FIGURE which shows for example how a coking operation according to the invention may progress. This FIGURE is in the form of a plot of underfire gas quantity for a heating flue as a function of the elapsed coking time and relates to a specific set of operating conditions. The underfire gas quantity is given in terms of normal cubic meters of gas per hour whereas the elapsed coking time is given in terms of hours.

The FIGURE relates to an oven having a working volume of about 20 cubic meters and a chamber width of 450 millimeters. In the FIGURE, the heat supply according to the invention is represented by the underfire gas quantity, that is, the amount of underfire gas supplied per unit of time. For the purpose of comparison, the heat supply for the conventional operation wherein a constant quantity of heat is continuously supplied to the coke oven is also shown in the FIGURE. The heat supply for the conventional operation, which is likewise represented by the underfire gas quantity, is indicated by the broken, horizontally extending line. It may be seen that the heat supply for the conventional operation is denoted by a value of the underfire gas quantity of 150 normal cubic meters per hour.

Discussing now the method according to the invention with reference to the exemplary embodiment of the FIGURE, it is pointed out that, for the first 3 hours of the coking period, an underfire gas quantity of 250 normal cubic meters per hour is supplied to each heating flue. After 3 hours, the heat supply is reduced in accordance with the invention. In the illustrated embodiment, the heating is discontinued completely after 3 hours, that is, the heat supply is reduced to zero. The heat supply is here discontinued for a period of 1 hour. Thereafter, that is, after a total of 4 hours of coking time has elapsed, heating is begun once more. In the present instance, this second heating stage is carried out with an underfire gas quantity which is less than that used in the first heating stage. Thus, it may be seen that the underfire gas quantity used in the second heating stage has a value of 175 normal cubic meters per hour. The second heating stage is here carried out for a period of 4 hours. Subsequently, that is, after a total elapsed coking time of 8 hours, the heat supply is reduced once more. In the present embodiment, the reduction in the heat supply again consists in shutting off the heat supply completely, that is, in reducing the heat supply to zero. As shown in the FIGURE, this second reduction in the heat supply is continued for a period of 4 hours. Thereafter, that is, after a total of 12 hours of coking time has elapsed, heating is once again begun. As may be seen, the initial part of this third heating stage is here carried out with an underfire gas quantity which is again less than that used in the first heating stage. The initial part of the third heating stage spans a period of 1 hour in the present instance. Subsequently, that is, after a total elapsed coking time of 13 hours, the underfire gas quantity is raised to the starting value of 250 normal cubic meters per hour used for the first heating stage. The purpose of this sequence is to create the most favorable thermal conditions for the following coking interval. The second part of the third heating stage, that is, the part of the third heating stage carried out with an underfire gas quantity of 250 normal cubic meters per hour, lasts for a period of 1 hour. Thereafter, that is, after a total of 14 hours of coking time has elapsed, coking is completed.

In the illustrative embodiment, the overall amount of underfire gas supplied to each heating flue during the entire coking period is 1875 normal cubic meters. When calculated per unit of time, the underfire gas quantity for each heating flue is found to have a value of 134 normal cubic meters per hour. This value of the underfire gas quantity is represented by the solid horizontal line in the FIGURE for the sake of comparison with the underfire gas quantity which is required for the conventional operation using a constant heat supply during the entire coking period. In comparison with the conventional operation, the invention results in a saving of 16 normal cubic meters per hour, that is, a saving of approximately 10 percent.

The foregoing results relate to a heating flue having a specified heating capacity which corresponds to the quantity of coal to be coked per unit of time. Naturally, different values for the amount of underfire gas per heating flue will result for other oven systems, and particularly for ovens having larger working volumes than that of the illustrative embodiment and which, correspondingly, are capable of operation with larger quantities of coal to be coked per unit of time. Similarly, a different value for the amount of underfire gas is to be expected when the coking period differs from that of the illustrative embodiment. The principle of the heating procedure in accordance with the invention is, however, not affected by this. Thus, it will be self-understood that a different amount of underfire gas per heating flue than above should be utilized when the throughput capacity per oven and the oven dimensions differ from those of the illustrative embodiment.

Generally, it is preferred, according to the invention, for the supply of underfire gas to the heating flues to be reduced after approximately 20 to 35 percent of the coking period has elapsed. Thus, as indicated previously, coking will progress in response to the supply of heat for the initial 20 to 35 percent of the coking period but will be essentially uninfluenced by the supply of heat for a certain time interval thereafter. In accordance with the invention, the supply of underfire gas is, after the initial 20 to 35 percent of the coking period, reduced to a level which is less than that required to sustain coking during those time intervals in which coking progresses in response to the supply of heat. Advantageously, the supply of underfire gas is throttled completely or practically completely subsequent to the initial 20 to 35 percent of the coking period. Practically complete throttling of the supply of underfire gas, or practically complete stoppage of the heat supply, will herein be understood to mean a reduction in the heat supply to a maximum of about 20 percent of the heat supply used heretofore, that is, a reduction in the amount of underfire gas to a maximum of about 20 percent of the amount of underfire gas which has heretofore been supplied to the individual heating flues.

The first reduction in the heat supply, that is, the reduction which is effected after about 20 to 35 percent of the coking period has elapsed, is preferably maintained for approximately 5 to 15 percent of the total coking period.

In accordance with the invention, another reduction in the heat supply is favorably effected after about 50 to 60 percent of the coking period has elapsed. Thus, as also pointed out earlier, coking is practically uninfluenced by the supply of heat for a certain time interval beyond completion of about 50 to 95 percent of the coking period. According to the invention, this second reduction in the heat supply also involves reducing the heat supply to a level which is less than that required to sustain coking during those time intervals in which coking progresses in response to the supply of heat. It is again preferred for the heat supply to be stopped completely or practically completely. The second reduction in the heat supply may be maintained for a somewhat longer interval than the first reduction and, advantageously, the second reduction in the heat supply is maintained for an interval corresponding to about 20 to 35 percent of the total coking period.

It is favorable for the performance of the heating procedure in accordance with the invention to be regulated via a programmed control apparatus which, in turn, is connected with valves which are provided for the heating flues. In other words, it is favorable for the heating procedure of the invention to be carried out automatically. The reason is that this enables a savings in heat to be achieved with the greatest reliability.

It will be understood that each of the elements described above, or two or more together, may also find a useful application in other types of processes differing from the types described above.

While the invention has been illustrated and described as embodied in a method of coking coal, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A coking method, comprising admitting a cokable substance into a least one coking chamber; supplying to said chamber, during periods in which coking of said substance progresses in response to the supply of heat, a quantity of heat which is sufficient to cause coking of said substance; and shutting off the heat supply to said chamber during periods in which the coking continues without supply of heat; said steps of heat supply and heat shut-off including supplying heat for an initial period and then alternately shutting off the heat supply and resuming the heat supply for at least two alternations of shut-off and heat supply subsequent to the initial heat supply period, the final heat supply of these alternations being the terminal period of the coking operation.

2. The method of claim 1, wherein said cokable substance comprises coal.

3. The method of claim 1, wherein said chamber is gas-fired.

4. The method of claim 1, wherein said heat supplying and shut off are carried out automatically.

5. The method of claim 1, said substance being admitted into a plurality of coking chambers which together constitute a group; and wherein the heating and heat shut off is carried out substantially concurrently for all of said chambers.

6. The method of claim 1 wherein the first shut off is carried out after about 20 to 35% of the total coking time has elapsed and is continued for a duration of 5 to 15% of the total coking time.

7. The method of claim 6 wherein the second shut off is carried out after about 50 to 60% of the total coking time has elapsed and is continued for a duration of about 20 to 35% of the total coking time.

8. The method of claim 1 wherein said shutting off of the heat supply is effected during two separate periods and the heat intermediate of said two shut off periods is supplied at a level below the level of the heat supply during the initial and terminal portion of the coking operation.

9. The method of claim 8 wherein the heat during the terminal heat period is supplied in two stages, the supply of heat in the first stage being below the level of said initial heating period while the supply of heat during the second stage immediately prior to termination of the coking operation is about at the level of said initial heating.

10. The method of claim 9 wherein the supply of heat during said first stage of the terminal heating period is about at the level of heat supply intermediate of said shut off periods.

11. The method of claim 9 wherein the said chamber is gas-fired and, relative to a total gas supply of about 1875 $nm^3$, the gas supply during the first heating period is about 250 $nm^3$ per hour, the gas supply during the second heat supply period intermediate of said two shut off periods is about 175 $nm^3$ per hour and the heat supply during the first stage of the terminal heat supply is about 175 $nm^3$ and the heat supply during the second stage of the terminal heat supply is about 250 $nm^3$ per hour.

12. The method of claim 9 wherein, relative to a total coking time of 14 hours, the initial heating period extends over 3 hours, thereafter the first shut off period extends over 1 hour, thereafter the second heating period extends over 4 hours and the second shut off period extends over 4 hours while the final heating period extends over 1 hour, each, in the first and second stage.

13. A coking method comprising admitting a cokable substance into at least one coking chamber; supplying to said chamber, during preselected time intervals within the coking period in which coking of said substance progresses in response to the supply of heat, a quantity of heat which is sufficient to cause coking of said substance; and shutting off the heat supplied to said chamber during two intermediate intervals within the coking period in which intervals continued coking of said substance is substantially uninfluenced by the supply of heat, the first shut off being effected after approximately 20 to 35% of the total coking period has elapsed and for a duration of about 5 to 15% of said coking time, and the second shut off being effected after approximately 50 to 60% of the total coking time has elapsed and is continued for a duration of about 20 to 35% of said coking time.

* * * * *